US007045701B1

(12) United States Patent
Walker et al.

(10) Patent No.: US 7,045,701 B1
(45) Date of Patent: May 16, 2006

(54) EXPRESSION SHOE

(75) Inventors: Robert A. Walker, Zionsville, PA (US); Kevin H. Light, Myerstown, PA (US); Jesse F. Dressler, Perkasie, PA (US); Scott J. Johnson, Seattle, WA (US)

(73) Assignee: Walker Technical Co., Inc., Zionsville, PA (US)

( * ) Notice: Subject to any disclaimer, the term of this patent is extended or adjusted under 35 U.S.C. 154(b) by 158 days.

(21) Appl. No.: 10/667,972

(22) Filed: Sep. 19, 2003

(51) Int. Cl.
*G10H 1/32* (2006.01)

(52) U.S. Cl. ..... 84/746; 324/207.2

(58) Field of Classification Search ..... 84/72, 84/225, 229, 353, 746; 324/207.2; 74/594.6
See application file for complete search history.

(56) References Cited

U.S. PATENT DOCUMENTS 3,558,793 A * 1/1971 Nakada et al. ..... 84/600
4,306,697 A * 12/1981 Mathews ..... 248/68.1
6,426,619 B1 * 7/2002 Pfaffenberger et al. .. 324/207.2

* cited by examiner

*Primary Examiner*—David Martin
*Assistant Examiner*—Jianchun Qin
(74) *Attorney, Agent, or Firm*—Edward J. Chalfie; Ladas & Parry LLP

(57) ABSTRACT

An expression shoe includes a pedal, a base, and a bearing arrangement rotatably connecting the pedal to the base. A sensor arrangement produces a senor signal corresponding to a rotational position of the pedal with respect to the base. The sensor includes a hall-effect sensor mounted to one of the pedal and the base and a magnetic field producing device mounted to the other of the pedal and the base for producing a linear output signal in response to movement of the pedal relative to the base.

8 Claims, 4 Drawing Sheets

EXPRESSION SHOE

FIELD OF THE INVENTION

This invention is directed generally to an advanced expression shoe, used for a pipe and/or electronic organ swell shade expression control.

BACKGROUND OF THE INVENTION

This invention is directed generally to one feature of a pipe or electronic organ, namely, the ability to control the expression of the music being played by varying the volume and timbre of the sound produced. This is usually done by using an "expression shoe," sometimes referred to as a "swell shoe." The expression shoe usually controls the volume of the organ sounds. In addition, the expression shoe may control the timbre along with the volume, as well as having one or more additional effects on the sounds produced.

In general, the expression shoe is a control, found on a pipe or electronic organ console, located beneath the keyboards, and usually directly above the pedal board. The expression shoe controls the "expression" or, as more commonly called, the "swell shades." In a pipe organ, the swell shades are used to vary the size of openings to the pipe chambers, where the organ sounds are produced. The chambers typically house a group of pipes or other sound-producing devices, which can be played from the organ console. Accordingly, the swell shades, which are typically movable "louvers," are controlled by the organist from the organ console, by moving the expression shoe. The position of the expression shoe therefore represents a relative position of the swell shades. With the shoe in the "closed" position, the swell shades are closed, reducing the amount of sound allowed to escape from the organ chamber. When the shoe is in the "open" position, the pipe chamber is nearly fully exposed, allowing the sounds produced to radiate out of the pipe chamber.

Expression shoe position detection has evolved over the years along with technology. Early systems connected the expression shoe directly to the shades via a mechanical linkage. When organs were first "electrified", the shoes were connected to a roller contact strip or multi-staged switch. This was typically a mechanical linkage connected from the shoe to a round wooden rod that had a metal contact embedded into the length of the rod on an angle. A multi-finger contact strip was then mounted so that the contact fingers slid on the rod, perpendicular to the length of the rod. As the shoe was moved, the metal contact strip would engage more or fewer of the finger contacts as the rod rotated. Each contact finger was typically connected to a solenoid, which rotated a louver on the expression shades. In some cases the fingers were "summed" to create an "analog" or "staged" input in order to achieve smoother movement of the shade transitions.

In newer systems, the expression shoe position is determined by the use of a mechanical linkage connected to a potentiometer, commonly referred to as a pot. The pot produces a linear signal that represents the shoe's position. This analog signal, typically a voltage, is sent to a control called a swell engine. The swell engine takes the analog signal and produces a motor control signal, which is fed to a motor. The motor, using a mechanical linkage, controls the position of the swell shades. Using this system, the swell shades can be precisely controlled by the expression shoe.

Some swell engines are designed to take an analog signal as an input, or a staged input as described above, to provide maximum flexibility.

There are several problems typically associated with the conventional expression shoes of the types described above. In the contact finger systems, the contacts wear and corrode, eventually making them intermittent. Expression shoes using a potentiometer have problems as well. For example, the potentiometer relies on a wiper sliding over wire windings or sliding on a film of a conductor which, after time, becomes dirty or worn causing intermittent "jumps" in the swell shade position when the expression shoe is moved.

Furthermore, expression shoes typically have an adjustable tensioning mechanism in order to provide a "feel." This mechanism typically relies on a controlled clamping of a control rod to provide the desired degree of resistance to movement. If not properly configured, this mechanism can wear, causing "slop" or an inconsistent feel to the expression shoe's action. Mechanical wear in the potentiometer can also compromise the desired "feel" as set by the latter mechanism.

We realized that there is a need in the organ industry for an expression shoe that will last the lifetime of an instrument without maintenance.

Conventional expression shoes have typically use a number of interconnected brackets to achieve the desired mounting with a structural member or surface of the organ. The fabrication and assembly of this bracket mounting system adds to the overall expense of fabrication of the expression shoe. Moreover, in order to accommodate mounting either to a rail-type member or a flat surface, different bracket arrangements have heretofore been provided. This further adds to the expense of the fabrication of the expression shoe, by requiring that multiple alternative brackets and related assemblies be provided and custom assembled, depending on the requirements for a particular installation.

The expression shoe of the invention has been designed to eliminate or reduce all of these potential problems. A hall-effect system has been chosen to measure the shoe's position, utilizing fixed magnets, without any moving parts. The tensioning mechanism on the expression shoe has been designed with material that has minimal wear and should not require additional adjustment for the life of the shoe after it has been initially set.

The expression shoe of the invention utilizes a novel and improved extruded mounting bracket, requiring a minimum number of fabrication and machining steps as well as a minimum amount of additional mounting hardware. This greatly simplified mounting assembly, using a relatively simply fabricated extrusion overcomes the above-noted problems in conventional expression shoe mounting bracket arrangements.

OBJECTS OF THE INVENTION

Accordingly, it is an object of the invention to provide a novel and improved expression shoe which overcomes the above-discussed shortcomings of conventional expression shoes.

SUMMARY OF THE INVENTION

Briefly, in accordance with the foregoing, an expression shoe comprises a pedal; a base; bearing means rotatably connecting said pedal to said base; sensor means for producing a sensor signal corresponding to a rotational position of said pedal with respect to said base; said sensor means comprising a hall-effect sensor mounted to one of said pedal and said base and magnetic field producing means mounted to the other of said pedal and said base for producing a linear output signal in response to movement of said pedal relative to said base.

In accordance with another aspect of the invention, a base for an expression shoe comprises a U-shaped portion having an open end, and two feet extending oppositely outwardly of sides of said channel at said open end.

In accordance with another aspect of the invention, a method of expression control for use with an organ comprises providing an expression shoe comprising a base and a pedal mounted for rotational movement relative to said base; producing a linearly varying signal in response to rotation of said pedal relative to said base.

In accordance with another aspect of the invention, a method of mounting a swell pedal to an organ comprises providing a mounting base having at least two different mounting members for accommodating two different types of mounting configuration; and mounting said base to said organ.

In accordance with another aspect of the invention, a method of calibrating an expression pedal comprises switching a control system to a calibration mode; when in the calibration mode, moving said expression pedal from a full open position to a full closed position; the control system recording the movement of said expression pedal from its full open position to its full closed position; exiting the calibration mode; and the control system recording values corresponding to said full open and full closed positions and calculating a proportional output signal.

DETAILED DESCRIPTION OF THE ILLUSTRATED EMBODIMENT

Figure 1:
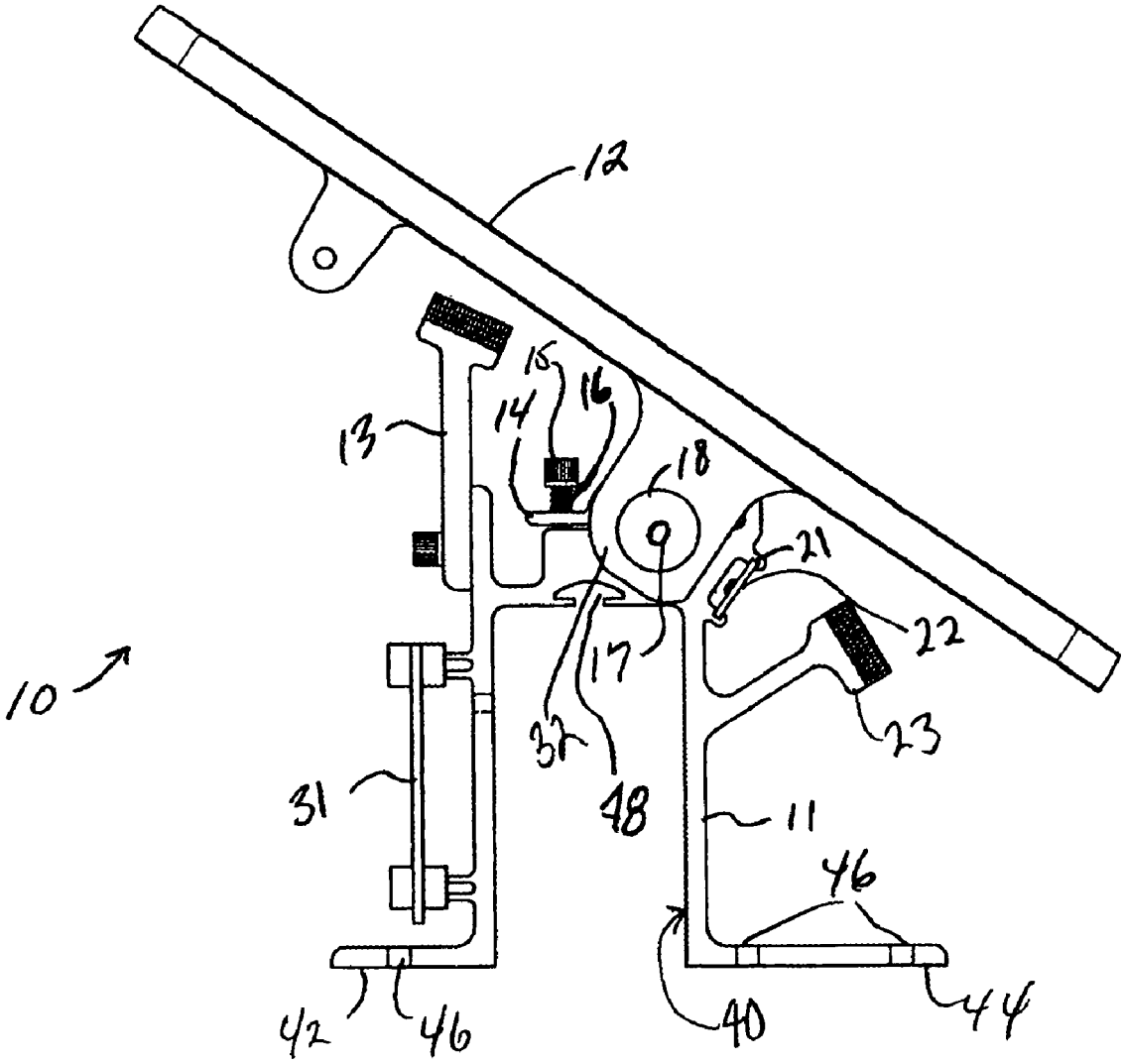
FIG. 1 is a side elevation showing an assembled expression shoe in accordance with the invention.
Figure 2:
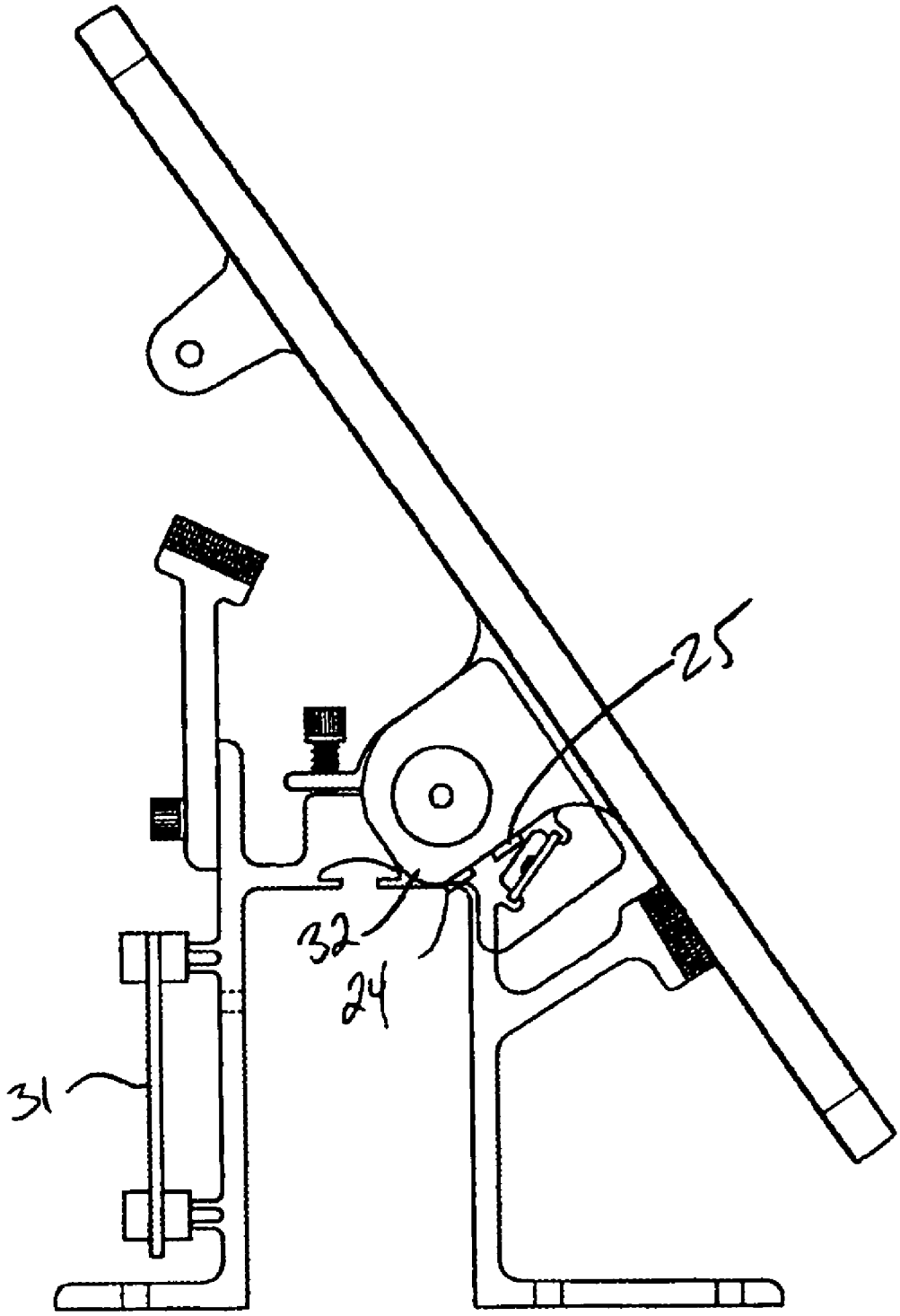
FIG. 2 is a side elevation, similar to FIG. 1, showing the expression shoe at one extreme of its range of travel.
Figure 3:
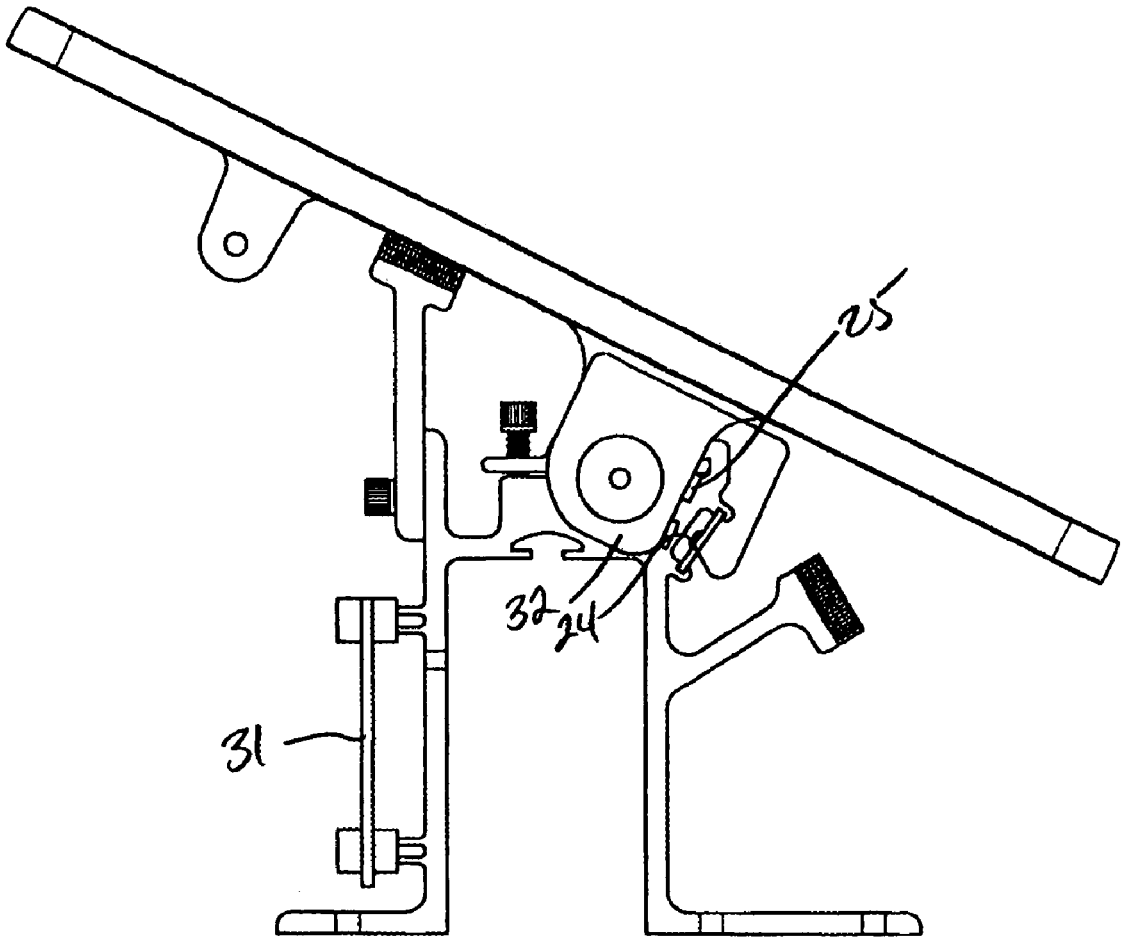
FIG. 3 is a view similar to FIG. 1 to showing the expression shoe at an opposite extreme of its range of travel.
Figure 4:
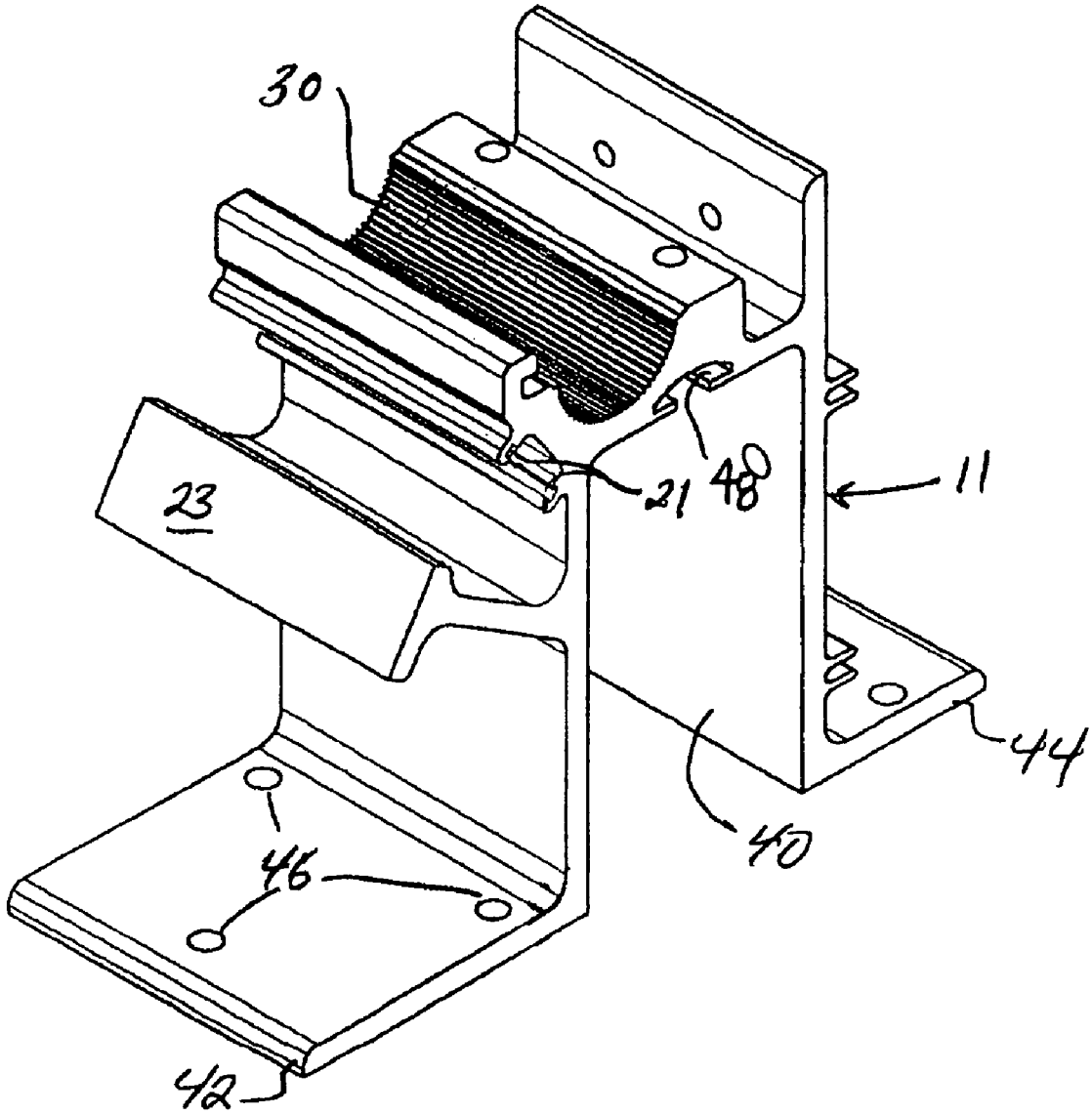
FIG. 4 is a perspective view of a novel mounting bracket portion of the expression shoe of the invention.

Referring now to the drawings, and initially to FIGS. 1–3, a pedal portion 12 of a shoe 10 is held to a base 11 by an extruded clam-shell piece 14 that is used as a tensioning device. The clamshell 14, along with a mating channel 30 (see FIG. 4) in the base 11, is used to compress a sleeve bearing 18 surrounding a shaft 17 to provide pedal movement resistance. The clamshell compression on the bearing and shaft is regulated by using adjustment screws 15 and springs 16. This resistance is provided in order to provide a "feel" to the shoe 10. Advantageously, in this bearing and tension system, the compression channel 30 is very easily created from the extrusion process. Moreover, this "hinge" mechanism requires very little post-extrusion machining. The only machining required is simple boring and tapping for the tensioning bolts and the shaft retention screws.

As a further advantage, the base is also a "universal" configuration. By design it has been configured to be a drop-in replacement for several past and current shoe designs. In the illustrated an embodiment, the base 11 is a single extrusion. This extruded base 11 provides for two forms of mounting. Firstly, the extrusion 11 provides a rectilinear open-ended recess or cavity for receiving a similarly shaped rail of an organ, to which the shoe is to be mounted. Secondly, the extrusion 11 is provided with a pair of outwardly extending feet 42, 44 which are provided with through bores 46 for receiving mounting hardware such as screws or other fasteners for mounting to a flat surface.

The invention uses a hall-effect system to replace the "pot" or "contact fingers" with a non-contact measurement system, thereby avoiding the above-noted difficulties with these prior art systems. A hall-effect sensor circuit board 22 is mounted in slots 21 provided in the base 11. The sensor board 22 contains a linear hall-effect sensor with a known gauss-per-volt output. Two small cylindrical magnets 24, 25 are mounted on a pedal arm 32. The magnets 24, 25 are mounted, side by side, with opposing polarity, to extend the magnetic flux pattern. This configuration provides a near linear magnetic flux curve, as viewed by the hall-effect sensor on the board 22 for the duration of the pedal's rotational travel.

The hall-effect sensor output, which is a variable voltage, is directed to an optional processor board 31 via wires (not shown). The processor board 31 conditions the voltage produced by the magnet-sensor interaction, and generates a voltage signal, proportional to the shoe position, to be used to control a swell engine. If the swell engine or other console control system is already configured to handle the voltage signals produced by the sensor board directly, the processor board 31 does not need to be included in the system.

For the control system, which can be the processor board 31, console control, or swell motor controller, to correctly produce an accurate swell shade output, the expression shoe should be calibrated. This is accomplished by the user switching the control system into a calibration mode. When in the calibration mode, the pedal is moved from its full open position, against a stop 23 (see FIG. 2) to its full closed position against a backstop 13 (see FIG. 3). The control system records this movement as the maximum expression shoe travel. When the forgoing pedal travel has been accomplished by the user, the user exits the expression shoe calibration mode of the control system. After exiting the calibration mode, the control system records the limit values in a non-volatile memory. These values can then be used in calculating the proportional voltage output based on the positional voltage generated by the magnet-hall effect sensor output.

The above-described expression shoe has several significant advantages over conventional expression shoe designs. Among these are the following:

The design of the expression shoe base has a unique shape, which has been developed to maximize the expression shoe's use potential. The base has two feet 42, 44 with holes 46, so that the shoe may be mounted to a flat surface, such as a pedal board. This feature matches a shoe design created by Skinner in the early 1920's. The base also has an upside-down "U" shaped pocket 40, located between the two feet, to allow the expression shoe to be mounted over a supporting member of the organ console knee-board. Transverse receiving slot 48 is provided to secure the base to the supporting member by receiving the head of a carriage-bolt secured to the supporting member. In this application, the horizontal "feet" can be cut off to make a neater appearance. By removing other portions of the "feet", most other expression shoe manufacturer's expression shoe mounting patterns can be matched, thus providing a universal mounting base for the expression shoe of this invention.

The expression shoe base was designed to be manufactured inexpensively. This is achieved by using an extrusion process. The base 11, the back stop 13, and the tension cap 14 are all produced via the extrusion process. Most other manufacturers use a cast iron or aluminum base or a formed or stamped metal plate system which incorporates the expression pedal hinge and position pick-up system. Most of these designs are specific to the manufacturer. The linear hall-effect, no moving parts, design is a first for this industry. Some manufacturers have used magnets with hall-effect switches or reed switches actuated by the presence of a magnetic field to generate output "steps" as the expression shoe is moved throughout its travel. In this configuration, a magnet is mounted to a rod, which is passed near the switches to cause them to actuate as the shoe moves. This provides a limited number of practical outputs due to the physical space required to mount the switches. Our dual magnet, linear output design provides a continuously varying output, which is proportional to the expression shoe's travel.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An expression shoe comprising:

a pedal;

a base;

bearing means rotatably connecting said pedal to said base;

sensor means for producing a sensor signal corresponding to a rotational position of said pedal with respect to said base;

said sensor means comprising a hall-effect sensor mounted to one of said pedal and said base and magnetic field producing means mounted to the other of said pedal and said base for producing a linear output signal in response to movement of said pedal relative to said base;

wherein said base includes a generally inverted U-shaped channel and a pair of feet extending oppositely outwardly of said channel for accommodating two or more different mounting configurations.

2. The expression shoe of claim 1, wherein said bearing means includes adjustment means for adjusting resistance to rotational movement of said pedal with respect to said base.

3. The expression shoe of claim 1, wherein said base comprises an extrusion.

4. The expression shoe of claim 1 wherein, said magnetic field producing means comprises a pair of spaced apart permanent magnets.

5. A base for an expression shoe, said base comprising:

a generally U-shaped channel, and a pair of feet extending oppositely outwardly of said channel for accommodating two or more mounting configurations.

6. The base of claim 5 wherein, said U-shaped channel and said feet are integrally formed as a single extrusion.

7. A method of mounting a swell pedal to an organ, said method comprising:

providing a mounting base having at least two different mounting members for accommodating two different types of mounting configuration, said mounting base having an inverted u-shaped channel and a pair of mounting ears extending oppositely outwardly from an open end of said channel Providing a bearing means rotatable connecting said pedal to said base;

mounting said base to said organ.

8. A method of calibrating an expression pedal, said method comprising:

switching a control system to a calibration mode;

when in the calibration mode, moving said expression pedal from a full open position to its full closed position;

the control system recording the movement of said expression pedal from its full open position to its full closed position;

exiting the calibration mode; and the control system recording values corresponding to said full open and full closed positions and calculating a proportional output signal.

* * * * *